US005355866A

United States Patent [19]

Hunter

[11] Patent Number: 5,355,866

[45] Date of Patent: Oct. 18, 1994

[54] POWER DART LAUNCHER

[76] Inventor: Gary R. Hunter, 2530 Oak Grove, Toledo, Ohio 43613

[21] Appl. No.: 124,335

[22] Filed: Sep. 21, 1993

[51] Int. Cl.[5] ..... F41B 7/00; F41B 7/08

[52] U.S. Cl. ..... 124/26; 124/16

[58] Field of Search ..... 124/16, 17, 20.1, 20.3, 124/26, 27

[56] References Cited

U.S. PATENT DOCUMENTS

| | | | |
|---|---|---|---|
| 267,679 | 11/1882 | Crandall | 124/17 |
| 1,287,401 | 12/1918 | Nicholas | 124/26 |
| 1,827,023 | 10/1931 | Keseleff | 124/17 |
| 2,017,778 | 10/1935 | Vido | 124/26 |
| 2,106,400 | 1/1938 | Brethen et al. | 124/27 |
| 2,663,291 | 12/1953 | Hall | 124/17 |
| 3,114,362 | 12/1963 | Hellman | 124/27 |
| 3,496,671 | 2/1970 | Korona | 124/26 X |
| 3,509,863 | 5/1970 | Barker | 124/16 |
| 3,949,729 | 4/1976 | Pfotenhauer | 124/20.3 |

*Primary Examiner*—Randolph A. Reese
*Assistant Examiner*—John A. Ricci

[57] ABSTRACT

A hand-held launcher for a dart comprises a pistol-shaped frame with a stock and handle. A channel is provided in the stock to receive a slidable launcher block. The dart is received in the launcher block. The launcher block is spring biased forward and retained from moving beyond a predetermined position by a stop block in the channel. Slots are provided on each side of the channel and the launcher block is retained in the channel by a cross pin which extends through the launcher block and into the slots. A release lever has two upper catches to engage the cross pin and retain the launcher block in the rearward cocked position. When the lever is pivoted, the launcher block is released and pushed forward by the spring until it contacts the stop block, whereupon the dart is released.

2 Claims, 4 Drawing Sheets

POWER DART LAUNCHER

BACKGROUND OF THE INVENTION

The primary objective of this invention is to add a new dimension to the game of darts, and provide a new way of playing a famous game with a high level of skill, where many more participants would play the game with enhanced skill levels, and also where many new participants who would or could be precluded from play, would be able to compete in the game of power darts on an even skill level with all players, whether they be handicapped physically or not.

FIELD OF THE INVENTION

This invention applies to the sport of throwing darts at a dart board, in regulated or non regulated dart throwing matches where full size regulation weight precision darts are used.

REFERENCES CITED

No other references in existence where a full size dart is launched.

DESCRIPTION OF PRIOR ART

Specific problems that this invention solves over prior art, exists in a different and easier way to play the game of darts, wherefore the skill of the game is greatly enhanced, with far less fatigue to the players who throw darts by hand, and also allowing people who are medically and physically restricted from playing the game, an opportunity to play at the same level as all others with an equal amount of skill, that the power dart launcher affords when launching full size regulation hand thrown type darts.

SUMMARY OF THE INVENTION

This invention incorporates seven main embodiments, a two piece symmetrical pistol grip like frame with a sliding spring actuated launch block, with a spring retainer and spring guide, where the spring loaded launch block is actuated by a hand lever attached to the exterior of the frame. Final features further include a rugged mechanism, that is easily manufactured with a high degree of precision, where all of the major parts are easy to maintain or replace as necessary. The mechanism is designed for long wear and durability, and is designed to be easily manufactured with typical and ordinary CNC machining modalities or investment cast processes.

DESCRIPTION OF THE PREFERRED DRAWINGS

DESCRIPTION OF THE PREFERRED EMBODIMENTS

Figure 1:
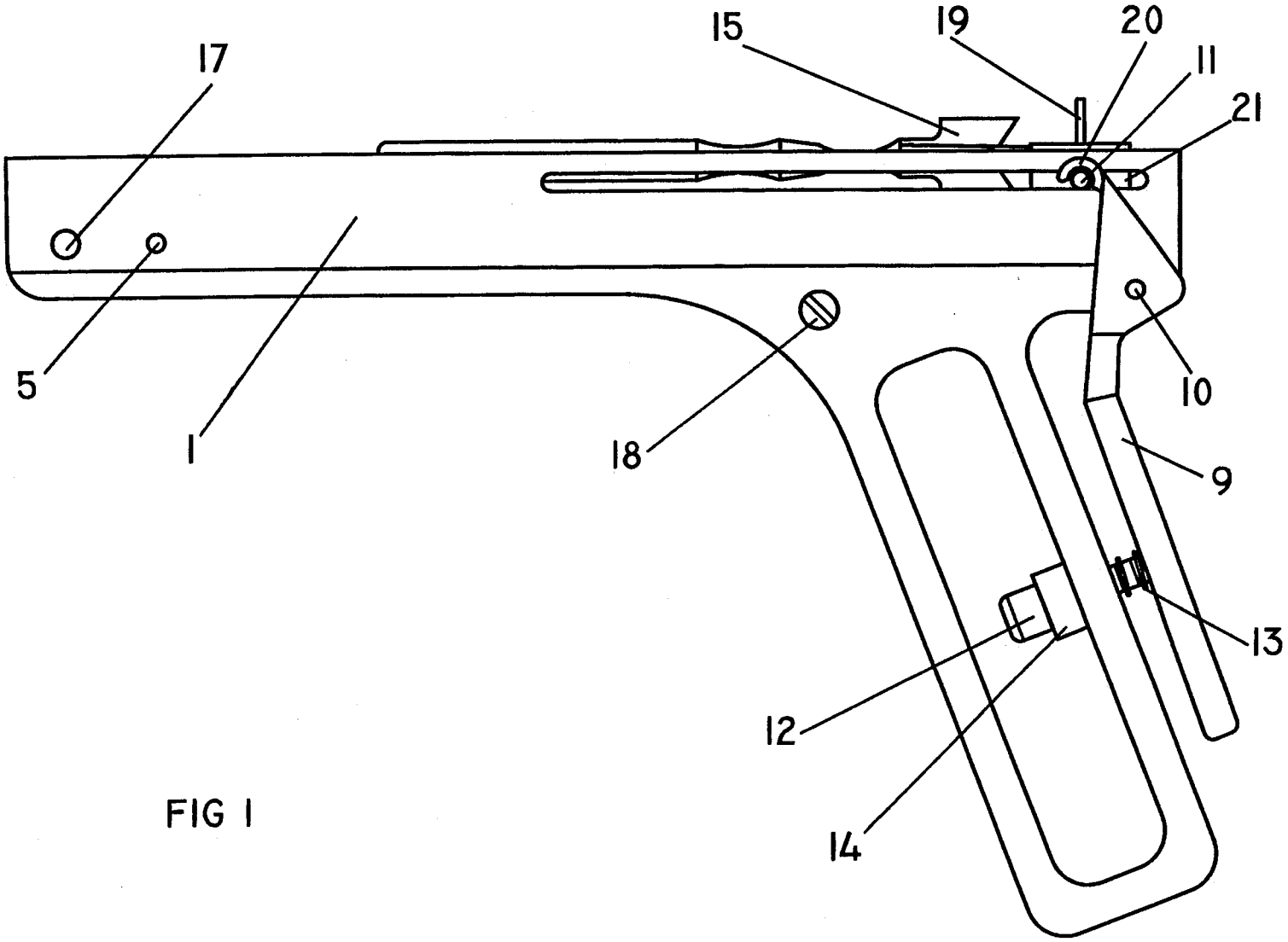
FIG. 1 is an elevation view of the power dart launcher according to the present invention.
Figure 2:
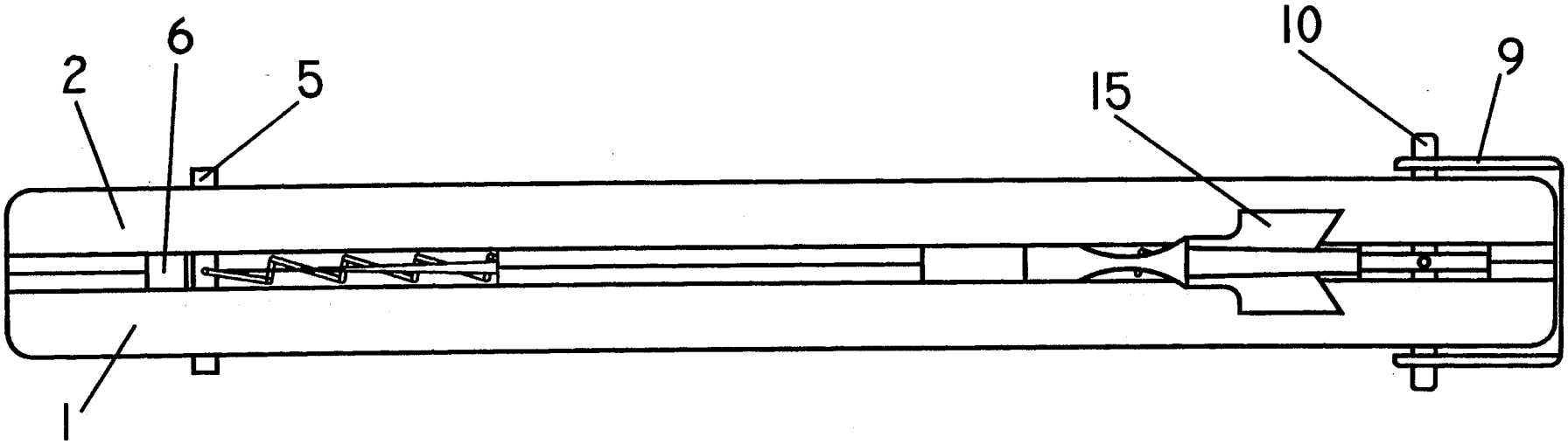
FIG. 2 is a top view of the power dart launcher according to the present invention.
Figure 3:
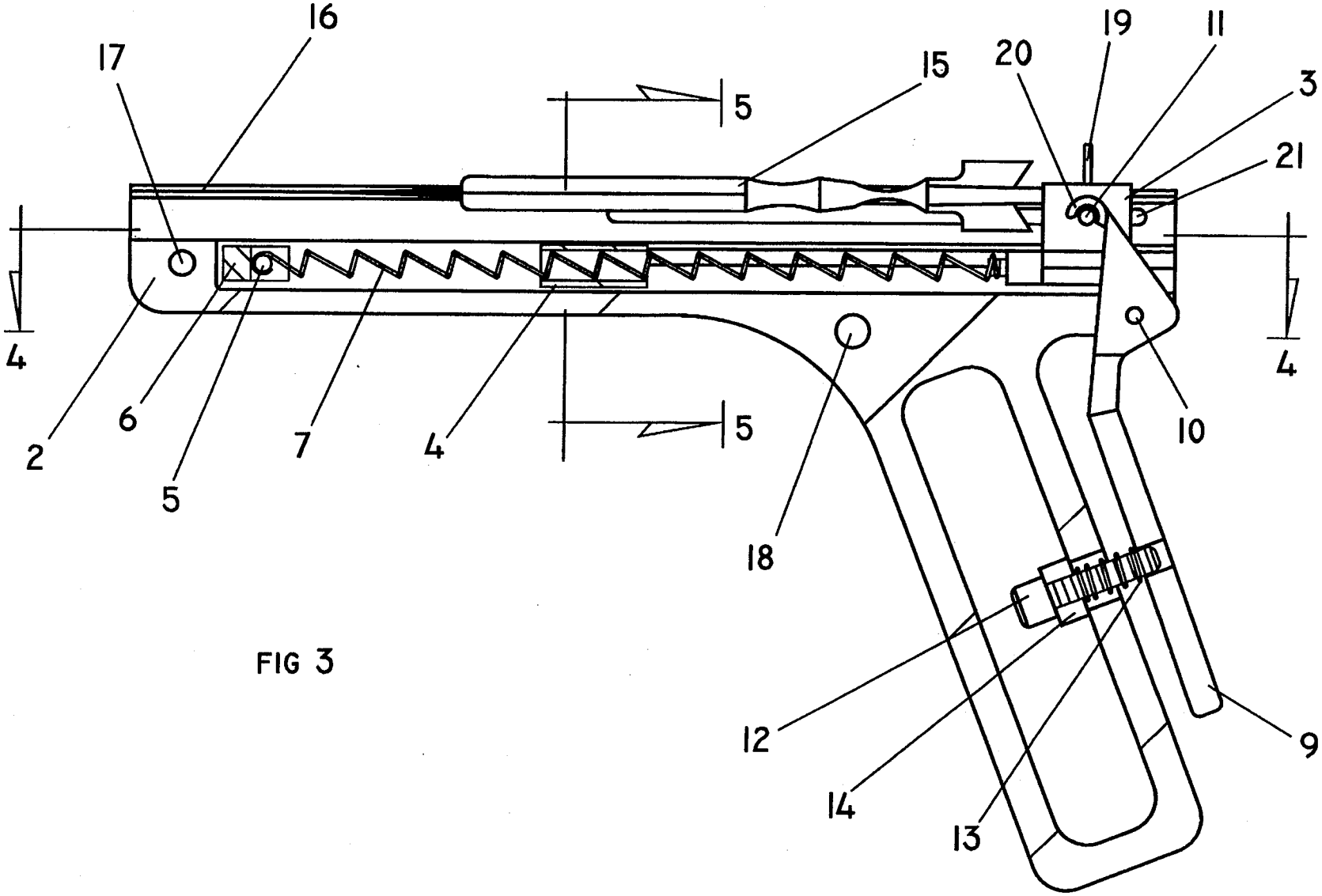
FIG. 3 is a side elevation fragmentary section view showing how the release lever, launch block, guide stop, and spring retainer are attached to the frame.
Figure 4:
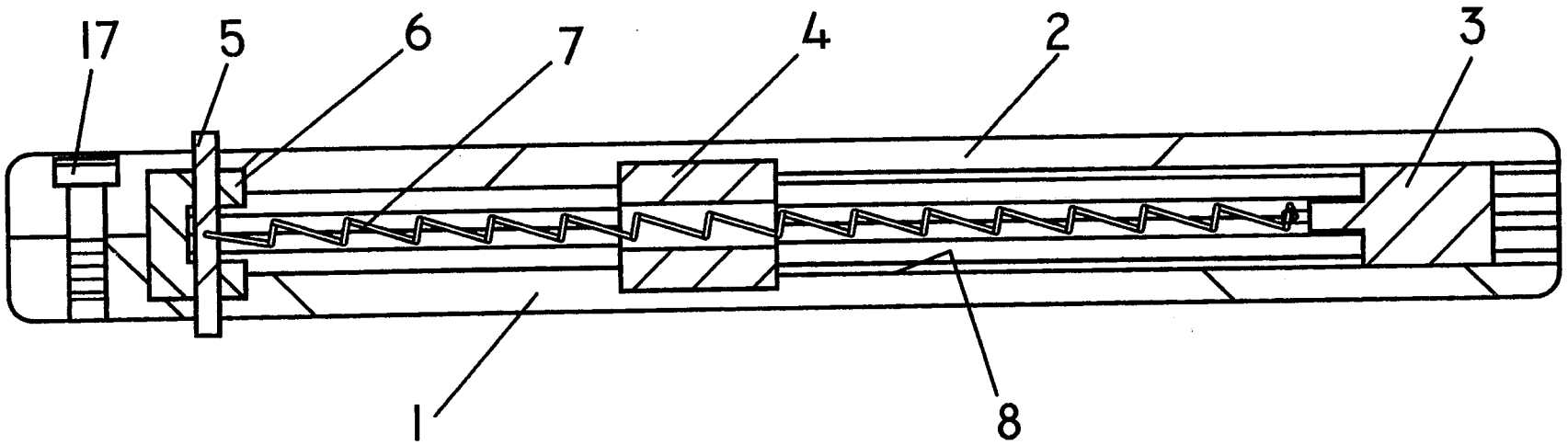
FIG. 4 is a top down fragmentary sectional view taken along section line 4—4 of FIG. 3 showing how the launcher block, stop block, and spring retainer are attached to the frame.
Figure 5:
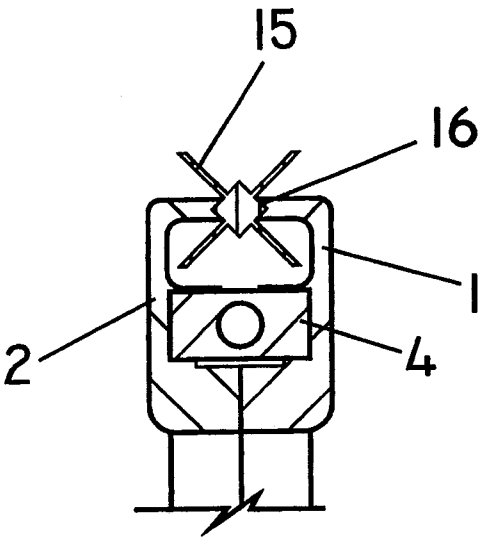
FIG. 5 is a fragmentary sectional view taken along section line 5—5 of FIG. 3 showing how the dart is ejected from the frame.

Referring to the drawings in detail wherein like numerals designate like parts: FIGS. 1 through 5 illustrate a pistol-like hand held launching device for darts. Shown are two symmetrical halves 1 and 2 forming the launcher body. A square-barreled dart 15 is inserted into the front of the device on its corners. The corners of the dart slide and fit into the milled in-way guides 16 (FIG. 3), along the horizontal plane of the longest extremity. Both halves of the pistol like body are milled, grooved, and slotted to accept the internal components which make up the working mechanism of the device. The dart 15 slides along the way guides 16 where it comes to seat up against a sliding T-bar 3. The T-bar slides along a milled channel 8 and stops fast against stop block 4 to expel the dart with the force of shock inertia impact. A tension spring 7 attached to retainer pin 5 and secured in retainer block 6, passes through a center hole in stop block 4 and is connected to sliding T-bar 3. Sliding T-bar 3 is held into position by release handle 9 which pivots on fulcrum pin 10. When release lever 9 is depressed, ears 20 lift off of protruding pins 11 and allows spring 7 to urge sliding T-bar against stop block 4 under strong tension allowing dart 15 to be thrust forward with speed and force. Cap screw 12 and spacer 14 can be adjusted to allow for adjustment of release tension by increasing or decreasing the tension on spring 13. After the forward cycle is complete, pin 19 is used to pull back the sliding T-bar 3 into the cocked position and engage the protruding pins 11, by hooking them into the curvature of ears 20. The slots 21 milled into the sides 1 and 2 of the pistol body serve as clearance for pins 11 when they thrust forward after release. The terms and expressions which have been employed herein are used as terms of description and not of limitation, and there is no intention in the use of such terms and expressions, of excluding any equivalents of the features shown and described or portions thereof, but it is recognized that various modifications are possible within the scope of the invention claimed.

I claim as follows:

1. A launcher device for a projectile such as a dart, comprising:

a pistol-shaped frame comprising an upper horizontal stock member, and downwardly depending handle, intermediate the ends of the stock member;

a lengthwise channel in said stock member;

a launcher block slidably mounted in said channel, said launcher block having means to receive said projectile; a launcher spring to bias said launcher block toward the front of the stock to a discharge position;

stop means mounted within said channel to prevent movement of said launcher block forward of a predetermined position;

two lengthwise slots cut through the frame walls into the channel, one on each side of the channel;

a cross pin extending through the launcher block and through the slots, each end of the cross pin extending outside of the frame;

retaining and triggering means comprising:

a fork-shaped lever, pivoted with a pivot at the rear of the stock member and behind the handle and below the channel;

the end of said lever above said pivot being bifurcated and terminating in catch means adapted to receive said cross pin outside said frame;

lever spring means below said pivot to bias the lever rearward away from the handle;

whereby, the catch means is biased downwardly into engagement with said cross pin to retain said launcher block in a cocked position; as a user pushes said lever forward, said catch means is disengaged from said cross pin allowing said launcher spring to accelerate said launcher block and projectile forward; when said launcher block contacts said stop means, the launcher block is abruptly stopped and the projectile is propelled forward.

2. The launcher of claim 1 in which said frame consists of two symmetric halves fastened together.

* * * * *